US006886549B2

(12) United States Patent
McPherson

(10) Patent No.: US 6,886,549 B2
(45) Date of Patent: May 3, 2005

(54) BOW LIMB FIXATION MEMBER

(76) Inventor: Matthew McPherson, 19055 Incline Rd., Norwalk, WI (US) 54648

( * ) Notice: Subject to any disclaimer, the term of this patent is extended or adjusted under 35 U.S.C. 154(b) by 0 days.

(21) Appl. No.: 10/321,988

(22) Filed: Dec. 17, 2002

(65) Prior Publication Data

US 2004/0112354 A1 Jun. 17, 2004

(51) Int. Cl.[7] ..... F41B 5/00

(52) U.S. Cl. ..... 124/23.1; 124/88

(58) Field of Search ..... 124/23.1, 25.6, 124/80, 86, 88, 89

(56) References Cited

U.S. PATENT DOCUMENTS

| | | | | | |
|---|---|---|---|---|---|
| 5,464,001 | A | | 11/1995 | Peck | 124/23.1 |
| 5,487,373 | A | | 1/1996 | Smith | 124/23.1 |
| 5,507,270 | A | * | 4/1996 | Smith | 124/23.1 |
| 5,515,836 | A | * | 5/1996 | Martin et al. | 124/23.1 |
| 5,720,267 | A | * | 2/1998 | Walk | 124/23.1 |
| 5,722,380 | A | * | 3/1998 | Land et al. | 124/25.6 |
| 6,257,220 | B1 | * | 7/2001 | McPherson et al. | 124/89 |
| 6,360,734 | B1 | * | 3/2002 | Andrews | 124/23.1 |
| 6,571,785 | B1 | * | 6/2003 | Choma | 124/25 |

* cited by examiner

*Primary Examiner*—Kien Nguyen
(74) *Attorney, Agent, or Firm*—Vidas, Arrett & Steinkraus

(57) ABSTRACT

An improved archery bow having innovative bow limb pockets.

27 Claims, 13 Drawing Sheets

BOW LIMB FIXATION MEMBER

CROSS-REFERENCE TO RELATED APPLICATIONS

Not Applicable

STATEMENT REGARDING FEDERALLY SPONSORED RESEARCH

Not Applicable

FIELD OF THE INVENTION

The present invention relates to archery bows and components thereof. In particular, the present invention relates to archery bows wherein the limbs can be separated from the handle. The present invention relates to an improved method of connecting a limb or limbs to a handle of an archery bow, and to the bow made by the same.

BACKGROUND OF THE INVENTION

Archery bows are available in a variety of forms and may comprise a vast range of designs and functions. Examples of bow designs include, but are not limited to, long bows, recurve bows, compound bows, and so forth. Bows have in common the fact that they are all basically intended to propel an arrow through the flexure of limbs that transfer stored energy through such flexure to the arrow through the bow string.

Many of the bow types including a recurve bow, compound bow, crossbow, and so forth are manufactured in three primary pieces including a pair of limbs attached to a handle portion. The handle portion may further include risers. Each limb may be attached to a handle portion or riser and secured using a limb pocket or box. Each limb pocket may receive an end of each limb for engagement to the riser surface. Each limb is held in place within the limb pocket by a limb bolt which passes through a hole or slot in the end of the limb to engage a threaded bore in the engagement surface of the handle portion. Limb pockets may be integral to the limb portion or may be separate members which mutually engage the handle portion and a limb end. Through the use of a limb pocket, a limb may be connected to the riser at various pivot angles. By adjusting the pivot angle a shooter has the ability to vary the relative bowstring tension and draw force required to pull the bow string. As a result, the force imparted to the arrow for a given pull distance on the bow string may be varied.

Perhaps the greatest problem with adjusting the attachment angle, however, is the tendency of the bow limb to twist sideways or misalign relative to the bow riser when the bowstring is pulled and/or released. This tendency can profoundly disrupt a shooters aim and accuracy.

The problem may be particularly acute in the case of a compound bow. Compound bows differ in that a block and tackle mechanism is used to bend the bow which includes a pulley and wheel system attached at the free ends of the limbs to obtain a mechanical advantage in bending the bow. The limbs can be made stiffer than, for example a longbow of the same draw weight. Eccentrically mounted wheels enable one to use a much higher maximum draw weight because they provide a substantial reduction in the holding force of a drawn bow.

Thus, the combination of stiffer limbs and greater draw weight results in the application of large forces to the components of the compound bow. These forces can have a moment from the centerline of the bow and/or from the plane of a drawn bowstring. The forces from the bowstring and cables wound on the wheels may not align with the mounting of the limb to the handle because of the way the bowstring and cables are wound, or because of a sidewards force caused by a finger release or a sidewards force due to a cable guard. The result is a force tending to move the free ends of the limbs from side to side, i.e. laterally, when the bow is drawn and/or fired.

Thus, the structure for attaching the limbs to the handle must be substantial enough to resist these forces in order for the bow to perform consistently. Various devices and methods have been developed to address the aforementioned problems, and further which enable adjustment of the attachment angles between the bow limbs and the handle portion or riser while restraining the bow limbs from experiencing side to side or lateral motion relative to the riser.

Various devices have been developed to overcome the above aforementioned problems including the tendency of the bow limb to twist laterally relative to the riser. These devices include both those that are integral with the handle portion, as well as those which are separable from it. U.S. Pat. No. 4,261,320 ('320) describes a compound bow having its bow limbs seated in a pocket formed in the riser itself.

U.S. Pat. No. 5,231,970 ('970) describes and claims an archery bow limb construction which includes an archery bow limb adapted to be adjustably mounted to a planar mounting surface of an archery bow riser. The bow limb includes a top surface, a bottom surface, a proximate end and a distal end. A slot and an aperture extend from the top surface of the bow limb to the bottom surface. The slot extends laterally from the proximate end of the bow limb toward the distal end and terminates at the aperture. A fastener can extend through the aperture and the planar mounting surface and be threadably received in the bow riser to adjustably secure the bow limb to the bow riser.

The improvement relates to a bushing which is received in the aperture of the bow limb. The bushing includes a first hole and a key which is snugly received in the slot of the bow limb. The first hole extends vertically through the bushing and is adapted to receive the fastener. The bushing can comprise a body portion and a head portion, and the body portion can comprise the key. The body portion can comprise a cylinder which is received in the aperture of the bow limb. The bow limb construction can include a washer which has a bore extending through it, wherein the bore communicates with the first hole of the bushing and is adapted to receive the fastener.

U.S. Pat. No. 5,280,779 ('779) describes an archery bow provided with pivoting pocket members for attaching each limb to the bow handle. Each pocket has an upper recess for receiving and laterally supporting a limb, and pocket walls which extend away from the recess to straddle the sides of the handle.

U.S. Pat. No. 5,433,792 ('792) describes a compound archery bow having a handle which includes a laterally opening pocket, a nut received in the pocket and a screw extending through the limb into the pocket and received in the nut. In another embodiment, a first opening with a threaded insert is provided in the handle. A second threaded opening intersects the first opening. A screw extends through the limb into the first opening. A set screw is provided in the second opening to lock the limb screw. In another embodiment, the handle is provided with an opening that tapers toward the rear. A tapered bushing is received in the opening. A screw extends through a cable guide into the bushing to mount same. In another embodiment, a limb pivot arrangement is provided which includes a pair of concave channels on the handle, and complementary part-spherical bosses on the limb.

U.S. Pat. No. 5,507,270 describes a limb pocket with a plurality of plastic inserts located about the interior of the pocket for receiving the butt of a limb. The interior width of the pocket is greater than the width of the butt of the limb and the inserts reduce the interior width of the pocket to less than the width of the limb butt. The inserts are slightly tapered and slightly resilient to assure a close fit between the pocket and the limb. The end wall of the pocket optionally includes inserts for separating the end of the limb from the end wall of the pocket. The walls and floor of the pocket include shallow recesses for locating the inserts.

U.S. Pat. No. 6,024,076 describes an archery bow including pivoting limb pockets for attaching two split limbs or a single limb to the bow handle. The limb pockets are secured to the handle by an adjustment bolt. Circular mating portions on the pocket and handle permit rotation of the pocket about the handle. A slug which is press-fitted in the handle provides lateral stability between the pocket and the handle. The front wall of the pocket prevents limb movement in the axial direction and the top surface of the pocket limits upward movement.

U.S. Pat. No. 6,244,259 describes a bow limb mounting system for adjustably mounting a limb inner end of a bow limb to a riser mounting surface of a bow riser of an archery bow. The limb inner end pivots relative to the bow riser about a limb pivot axis. The pivot movement is produced by an adjustable strut assembly which varies an attachment angle between the limb inner end and the riser mounting surface, while restraining lateral movement between the two. The adjustable strut assembly has upper head and neck portions which connect to the limb inner end in a close tolerance manner, and an alignment block portion below the neck portion which is slidably and matingly seated in a cavity located below the mounting surface also in a close tolerance manner. A bolt extends through a central hole formed by the head, neck and alignment block portions and connects to a pivot pin, such that adjusting the bolt changes the distance between the limb inner end and the pivot pin to thereby change the attachment angle.

It would be advantageous to provide a mounting system for adjustably mounting a bow limb to a bow riser, wherein the bow limb is laterally restrained relative to the bow riser in an efficient yet solid manner. Furthermore, an adjustable bow mounting system which pivotally compensates the strut assembly at various attachment angles would provide greater structural stability under the typically high bowstring tensions. It is also notable that due to the variations in bowstring tension which result from adjustment of the attachment angle, it would be further advantageous to provide a mounting system which measures and indicates relative bowstring tension at the various attachment angles.

All US patents and applications all other published documents mentioned anywhere in this application are incorporated herein by reference in their entirety.

SUMMARY OF THE INVENTION

The present invention relates to an improved archery bow which has an innovative bow limb securement member hereinafter referred to as a limb pocket. The limb pocket is designed to engage the bow limb in such a way that lateral movement is prevented. In one embodiment, the present invention relates to an archery bow including a handle, at least one limb and at least one limb pocket having a bottom, two side walls and an end wall portion. The limb pocket is engaged to an end of the handle and fully engages the limb on at least said two sides. The limb pocket may also engage the limb on the bottom and/or the end portion of the limb as well.

In one embodiment, the limb pocket tapers or converges and the limb tapers or converges accordingly. The side walls and end wall portion of the limb pocket substantially define the limb shape itself. The limb may optionally have a fork at the end where it is engaged to the limb pocket for receiving a limb bolt. Further, the limb pocket may have a threaded hole for receiving a limb bolt as well.

BRIEF DESCRIPTION OF THE SEVERAL VIEWS OF THE DRAWINGS

A detailed description of the invention is hereinafter described with specific reference being made to the drawings in which.

DETAILED DESCRIPTION OF THE PREFERRED EMBODIMENTS

Figure 1:
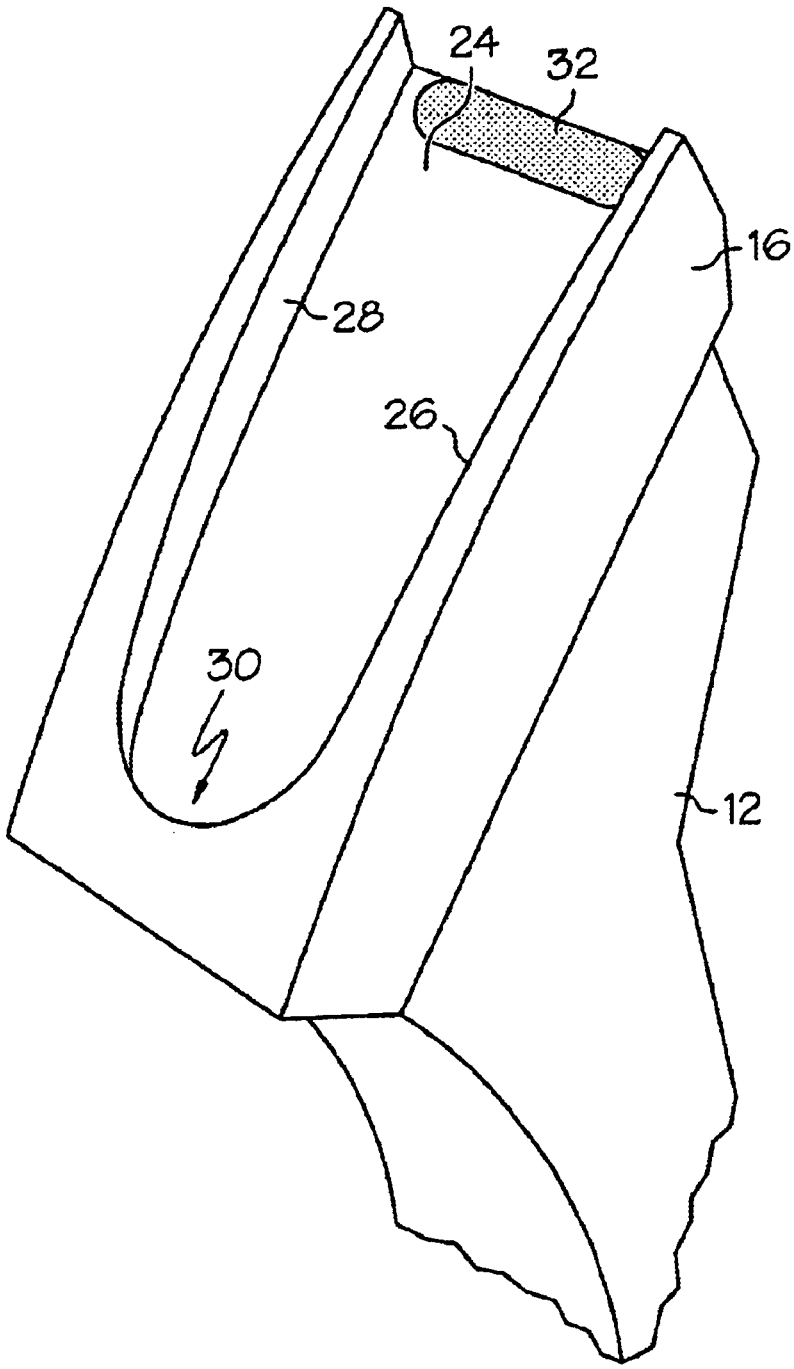
FIG. 1 is a perspective view of the limb pocket of the present invention.

While this invention may be embodied in many different forms, there are shown in the drawings and described in detail herein, specific embodiments of the invention. The present disclosure is an exemplification of the principles of the invention and is not intended to limit the invention to the particular embodiments illustrated.

Referring now to the drawings, FIG. 1 is a perspective view of an embodiment of the limb pocket or limb pocket 16 of the present invention shown engaged with a riser or handle portion 12 of an archery bow (not shown). Limb pocket 16 has two side walls 26, 28 for slidably engaging a limb bow (not shown) and a bottom 24 and end portion 30. Side walls 26, 28 are separated by a distance which is substantially equal to the width and shape of the limb portion 21 (FIG. 2) which is slidably engaged with limb pocket 16. Limb pocket 16 may further include a vibration damping device 32 to prevent a limb bow from vibrating against limb pocket 16.

Figure 2:
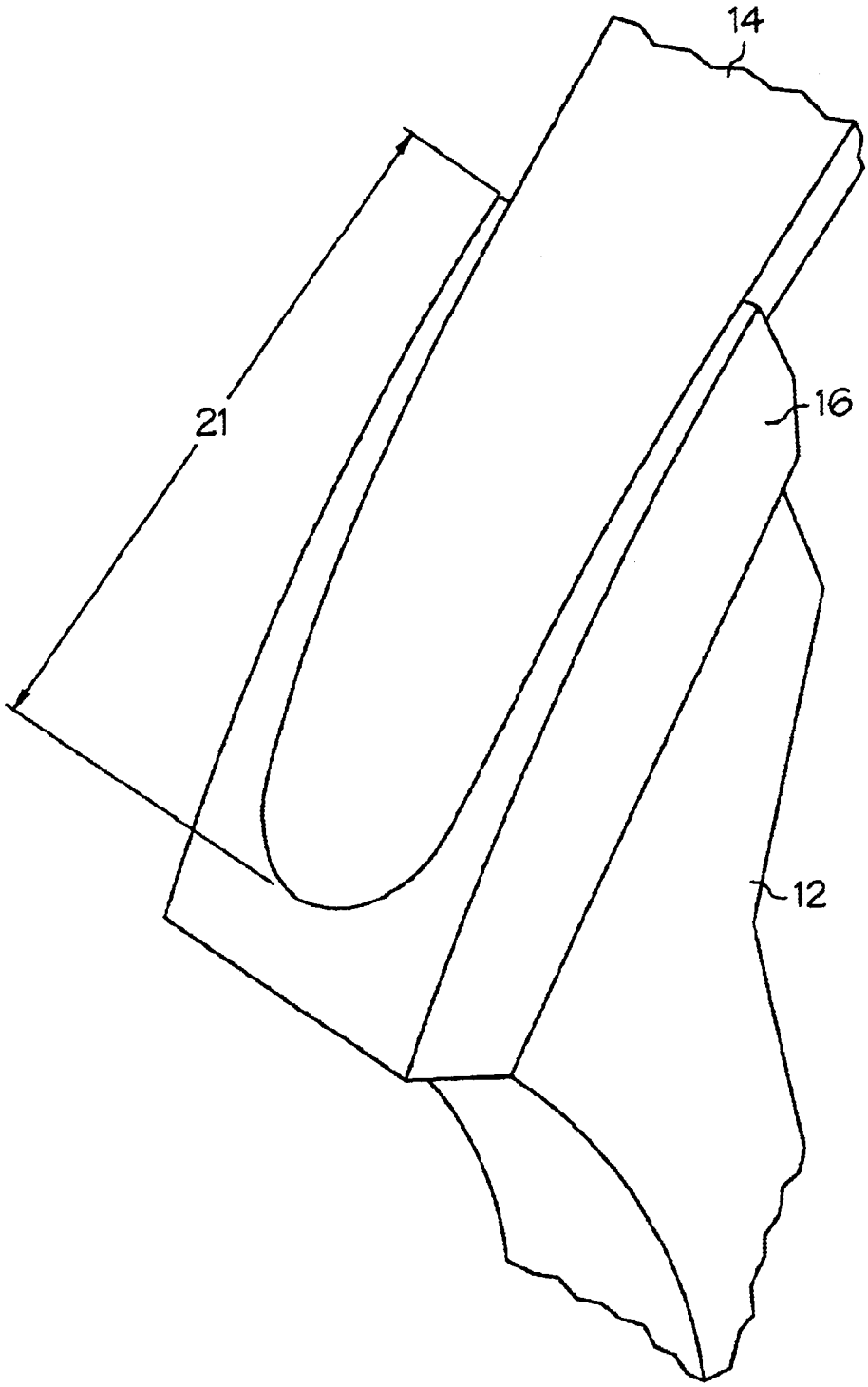
FIG. 2 is perspective view of an embodiment of the limb pocket of the present invention in which a partially forked limb is employed.

FIG. 2 is an alternative and partial view of an embodiment showing the innovative limb pocket 16 of the invention shown engaging a bow limb 14 and further engaged to riser 12. The innovative limb pocket 16 of the present invention prevents lateral or side to side movement of the limb.

Figure 3:
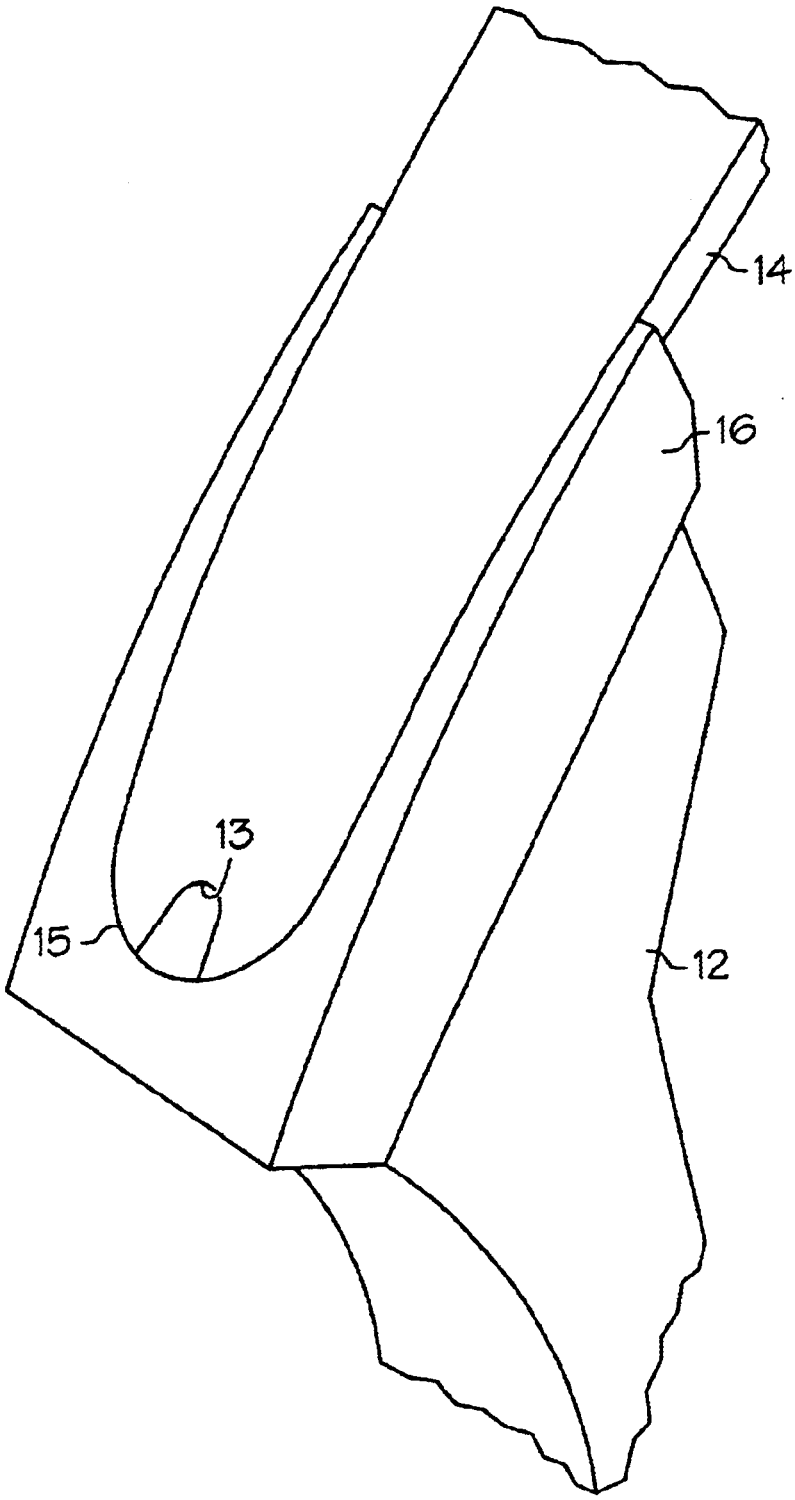
FIG. 3 is a perspective view of the limb pocket of the present invention in which a bolt or screw is shown for securing the limb, riser and limb pocket together.

FIG. 3 illustrates a similar embodiment to that shown in FIG. 2 but with limb 14 having a fork 13 at the end 15 of bow limb 14 which is in contact with limb pocket 16.

Figure 4:
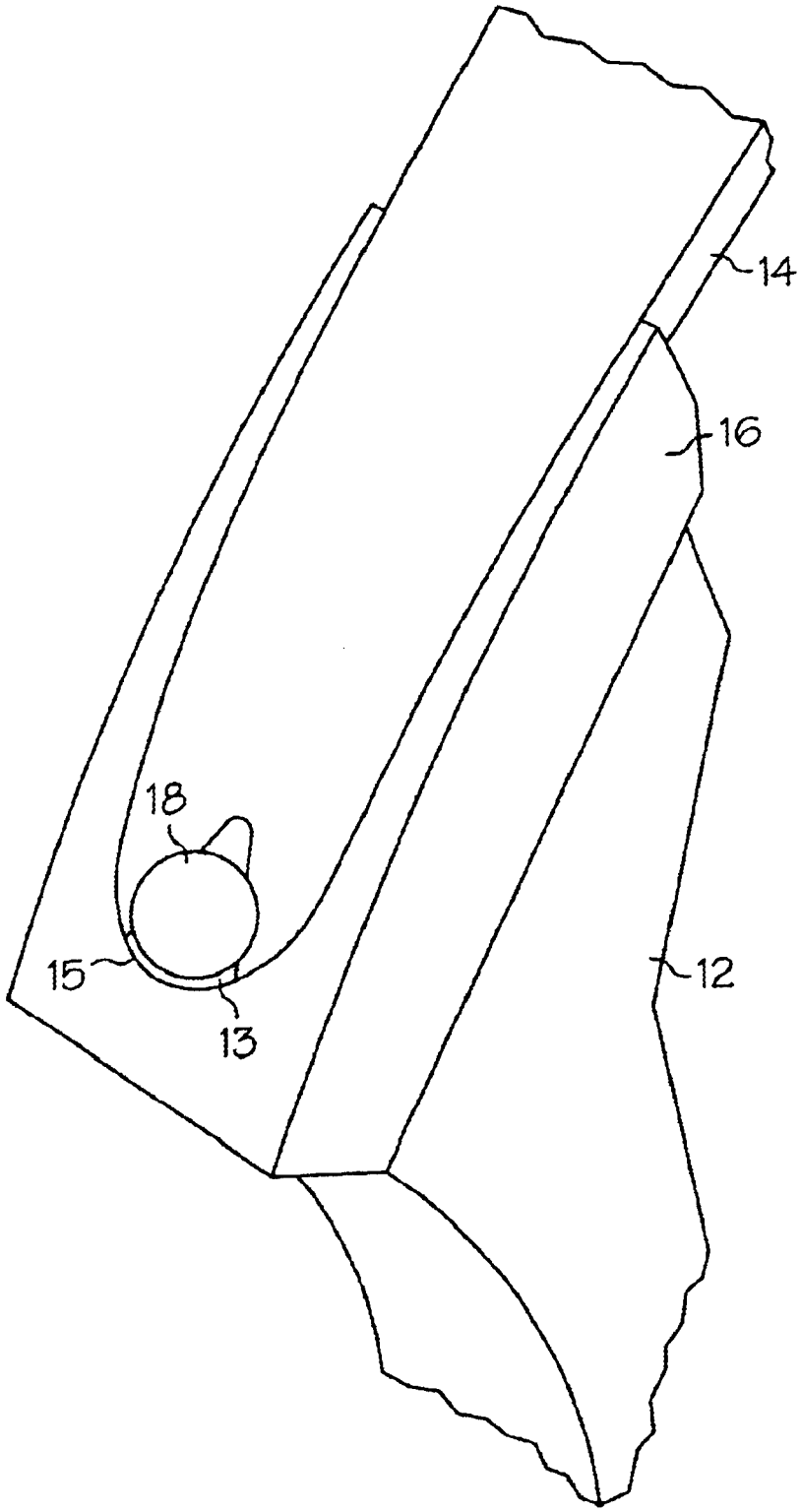
FIG. 4 is an alternative embodiment of the limb pocket shown in FIG. 2.

FIG. 4 illustrates a similar embodiment to that shown in FIGS. 1, 2 and 3 but with the forked end 15 of limb pocket 16 secured with a limb bolt or screw 18 which in turn secures both the limb pocket 16 and the limb 14 to the riser 12. Limb pocket 14 substantially fully slidably engages the bow limb 14 at least at the side walls of the limb pocket 16, but at least partially engages limb 14 at the bottom 24 of the limb pocket 16 as and/or at least partially at the end wall portion 30 of limb pocket 16 as well. The amount that the limb is engaged by the bottom 24 of the limb pocket 16 may be limited by the presence of a vibration dampening device 32 (FIG. 1) for preventing the bow limb 14 and the bottom 24 of limb pocket 16 from vibrating against one another. The amount of engagement of the bow limb 14 by the end wall portion 30 of limb pocket 16 may be limited by the presence of a forked end 13 of bow limb 14 for receiving a limb bolt (not shown).

Figure 5:
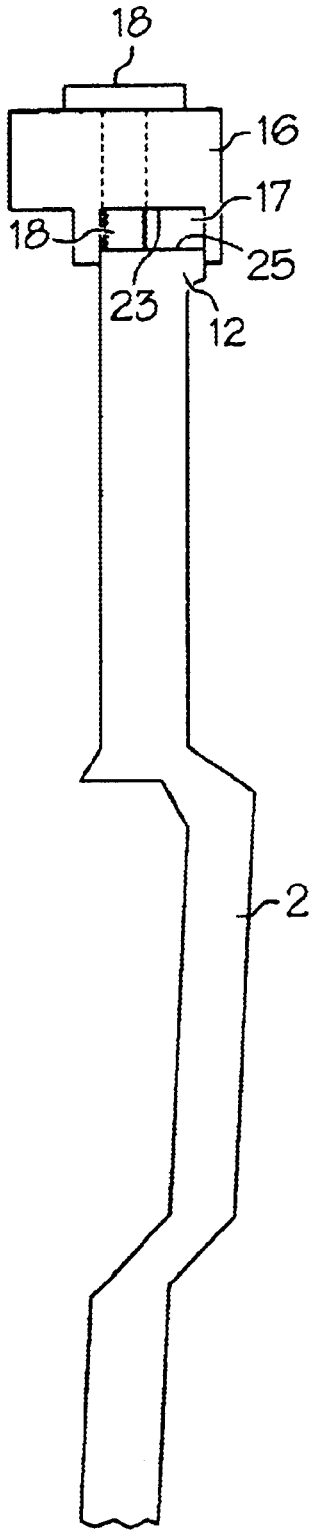
FIG. 5 is a frontal view of a riser of a compound bow showing the limb pocket of the present invention attached thereto.

FIG. 5 is a frontal view of a riser 12 of a compound bow shown engaged by a limb pocket 16 of the present invention with a bolt or screw 18. As can be seen from the figure, there is a space 17 between the bottom surface 23 of the limb pocket 16 and the top surface 25 of the riser or handle portion 12 which allows for longitudinal movement of the limb 14. This particular feature shall hereinafter be referred to as pivotal engagement between said limb and said riser or handle portion.

Figure 6:
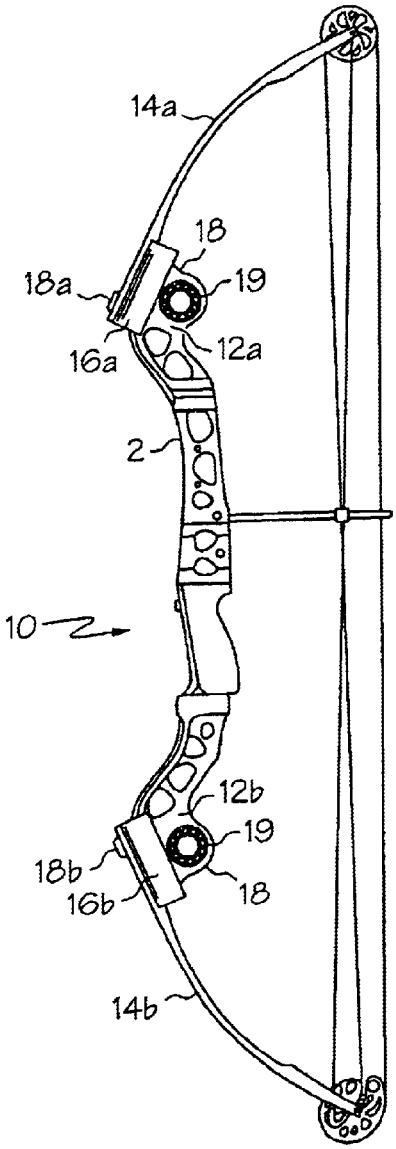
FIG. 6 is a side view of a compound bow having the limb pocket of the present invention.
Figure 7:
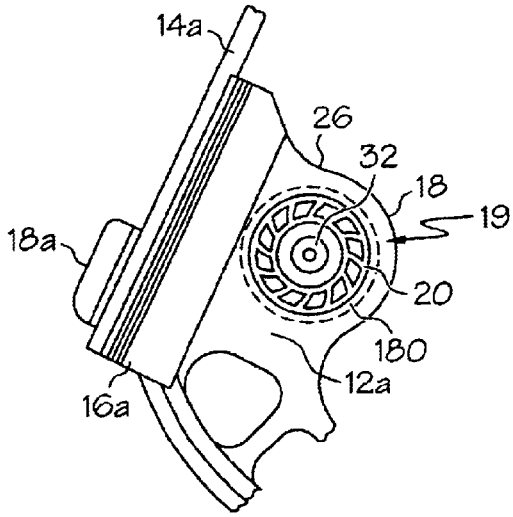
FIG. 7 is a close up view of the limb pocket as shown in FIG. 5.

FIG. 6 is a side view of a compound bow 10 having a bow handle 2 to which are attached an upper limb 14*a* and a lower limb 14*b*. The upper and lower limbs 14*a*, 14*b* are attached to the bow handle 2 at the risers 12*a*, 12*b* by the innovative limb pockets or cups 16*a*, 16*b* according to the present invention. Limb pocket 16*a* is attached to upper limb 14*a* and limb pocket 16*b* is attached to lower limb 14*b*. Limb pockets 16*a*, 16*b* and upper limb 14*a* and lower limb 14*b* are secured to riser 12 using bolts or screws 18*a*, 18*b*. FIG. 7 is an expanded view of the innovative limb pocket 16*a* as depicted in FIG. 6.

Figure 9:
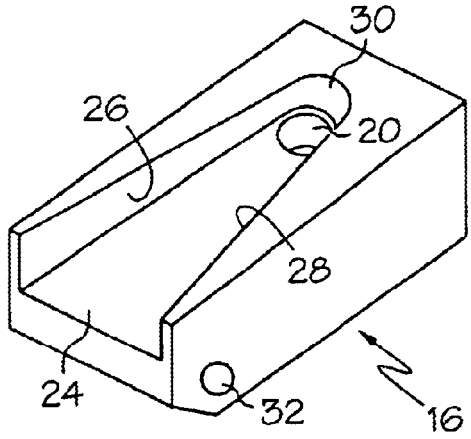
FIG. 9 is an enlarged view of the embodiment of the limb pocket shown in FIG. 8.

The bow 10 depicted in FIG. 6 is referred to as a compound bow because located at the extremities of each bow limb are the components comprising a variable leverage system which allows the user to hold the bow at full draw while expending less effort than required with a traditional bow as shown in FIG. 9 below and the recurve bow shown in FIG. 10, below. The compound bow of the type shown in FIG. 6 is found in commonly assigned U.S. Pat. No. 6,257,220 incorporated by reference herein in its entirety while the traditional and recurve bows are found in U.S. Pat. No. 5,592,929 and U.S. Pat. No. 5,408,982 both of which are incorporated by reference herein.

In a compound bow such as is shown in FIG. 6, a variable leverage device or cam 8 is pivotally mounted on axle 7 at the free end of the lower limb 14*b*. This particular arrangement has become well known as, the dual feed-out single take-up, single cam system and was first disclosed in U.S. Pat. No. 5,368,006 incorporated by reference herein in its entirety. While FIG. 6 depicts a compound bow having a single cam design, the innovative limb pockets 16*a*, 16*b* which are the subject of this patent, can be applied to compound bows of other designs as well as bows of traditional design.

Figure 8:
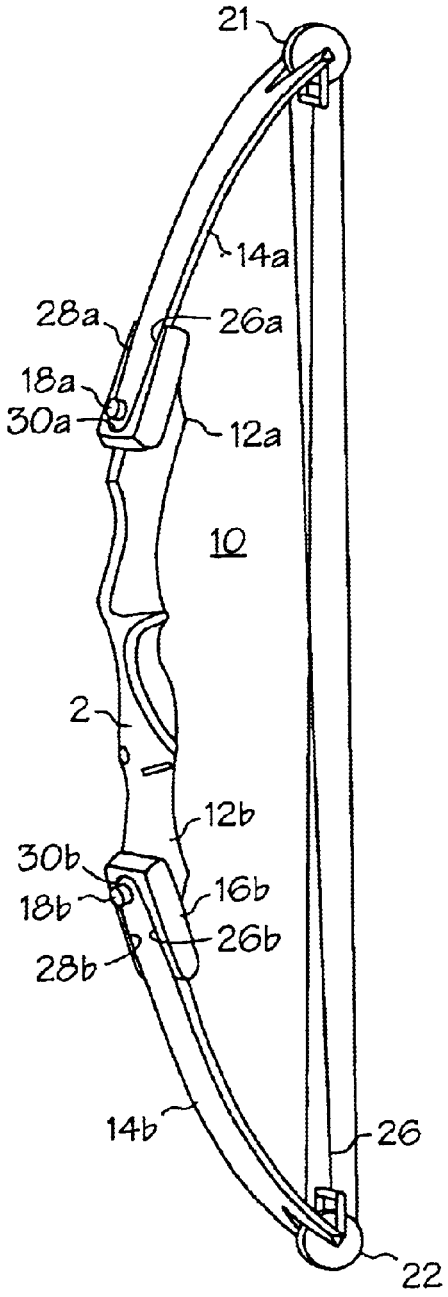
FIG. 8 is a side view of an alternative configuration of a compound bow according to the present invention.

FIG. 8 illustrates an alternative embodiment of a compound bow 10 having a bow handle 2 to which are attached an upper limb 14*a* and a lower limb 14*b*. The upper and lower limbs 14*a*, 14*b* are attached to the bow handle 2 at the risers 12*a*, 12*b* and are slidably and frictionally fully engaged to the innovative limb pockets 16*a*, 16*b* according to the present invention. Limbs 14*a*, 14*b* are slidably and fully engaged at side walls 26 and 28 of limb pocket 16*a*, 16*b* as shown in FIG. 9 wherein the limb pocket 16 is enlarged to illustrate certain features of the device. Limb pocket 16*a* is fully, slidably engaged to upper limb 14*a* at side walls 26 and 28 of the limb pocket 16, and also substantially at bottom 24 of limb pocket 16*a* as shown in FIG. 9 and at the end wall portion 30 as well. As can be seen from FIG. 8, the limb shape and the shape defined by the side walls 26*a*, 28*a*, bottom 24*a* (not shown; see FIG. 9) and end wall portion 30*a* of the limb pocket 16*a* are substantially the same. Likewise, limb pocket 16*b* is fully and slidably engaged to lower limb 14*b* at sides 26*b*, 28*b* of limb pocket 16*b*. Limb pockets 16*a*, 16*b* and upper limb 14*a* and lower limb 14*b* are further engaged to risers 12*a*, 12*b* using limb bolts 18*a*, 18*b*.

FIG. 9 is an expanded view of the innovative limb pocket 16 representative of both limb pockets 16*a*, 16*b* as shown in FIG. 8. Limb pocket 16 has two side walls 26 and 28 for slidably engaging bow limb 14 and further has a bottom 24 which substantially engages bow limb 14. Limb pocket 16 further has an end wall portion 30 and a threaded hole 20 for receiving limb bolt 18.

Figure 10:
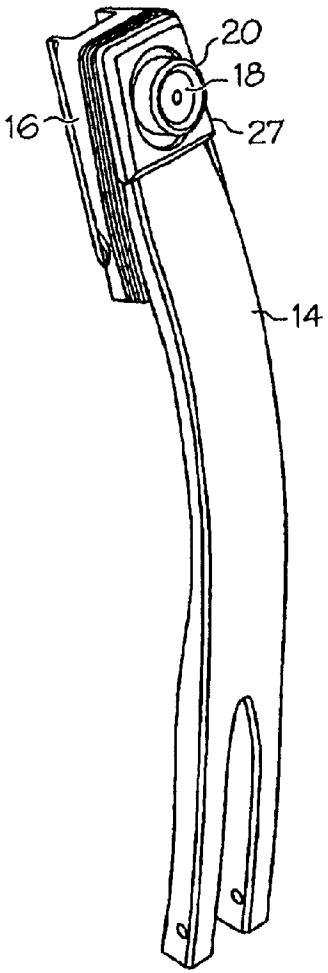
FIG. 10 is a perspective view of a limb pocket according to the present invention.

FIG. 10 is a perspective view of a bow limb 14 in combination with one embodiment of a limb pocket 16 according to the invention. The limb 14 is secured to limb pocket 16 with a bolt 18 and compression washer 20.

Figure 11:
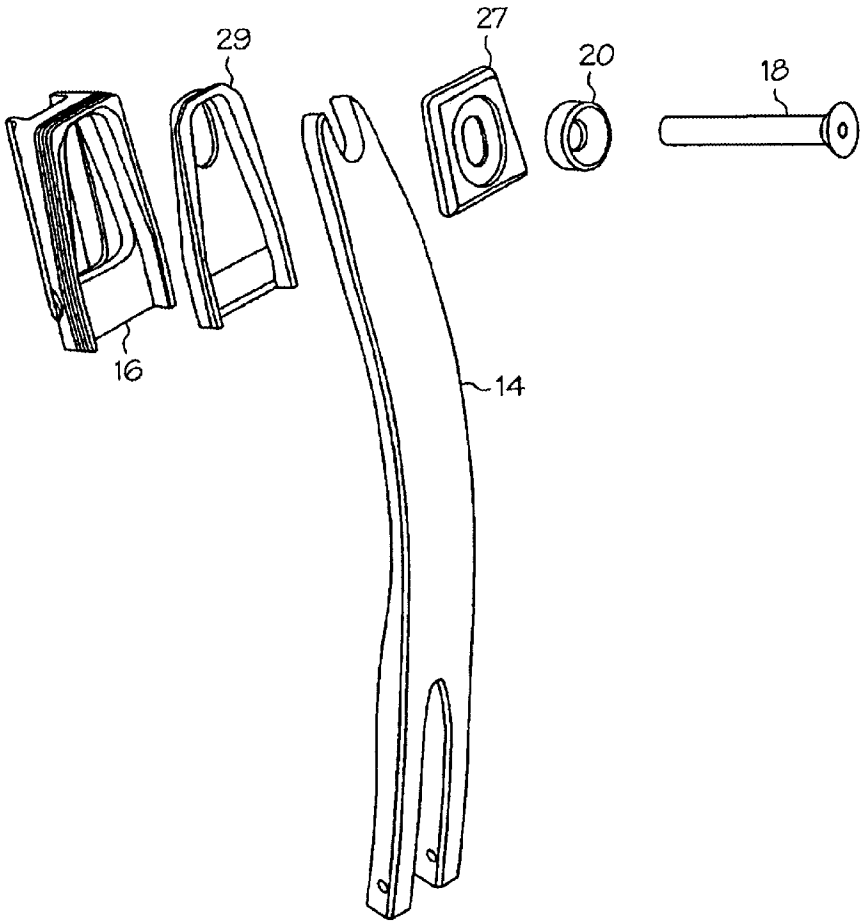
FIG. 11 is a perspective exploded view of the same limb pocket shown in FIG. 10.

FIG. 11 is an exploded perspective view of the bow limb 14 and limb pocket 16 combination according to the invention. Bow limb 14 is secured to limb pocket 16 with a bolt 18 and compression washer 20. Between compression washer 20 and bow limb 14 is a limb cap 27 to prevent direct contact between compression washer 20 and blow limb 14 and also to minimize vibration and noise. Also between bow limb 14 and limb pocket 16 is an insert or limb liner 29 also to prevent direct contact between bow limb 14 and limb pocket 16 and also to minimize vibration and noise.

Figure 12:
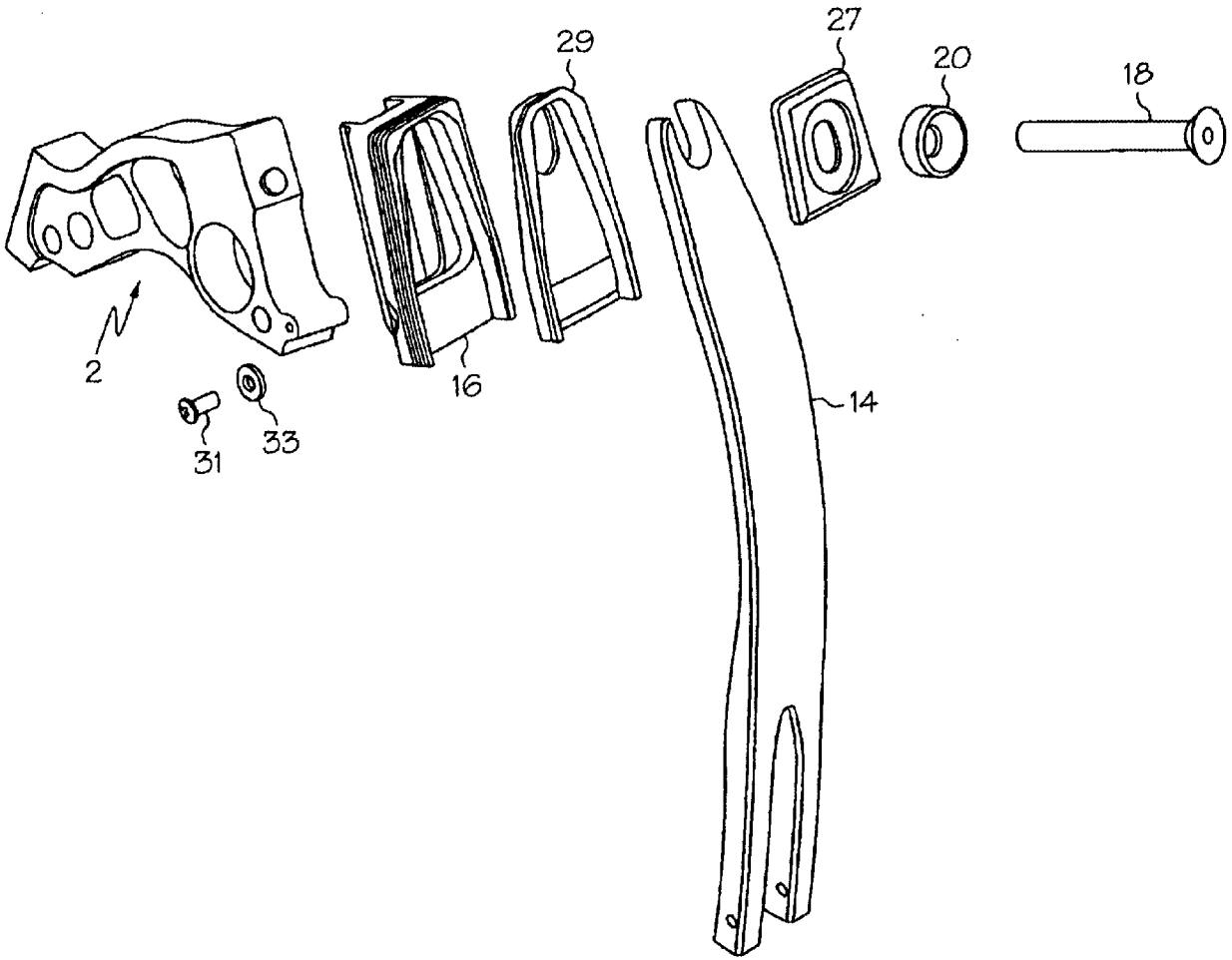
FIG. 12 is an exploded view of a limb pocket as shown in FIG. 10 and 11 further in combination with a bow handle.

FIG. 12 is an exploded perspective view of the same bow limb 14 and limb pocket 16 combination as shown in FIGS. 10 and 11 and shown further in combination with a bow handle 2 which is secured to limb pocket 16 with a button head screw 31 and washer 33 in this embodiment.

Other methods of securement known to those of skill in the art could also be employed in the above figures.

Figure 13:
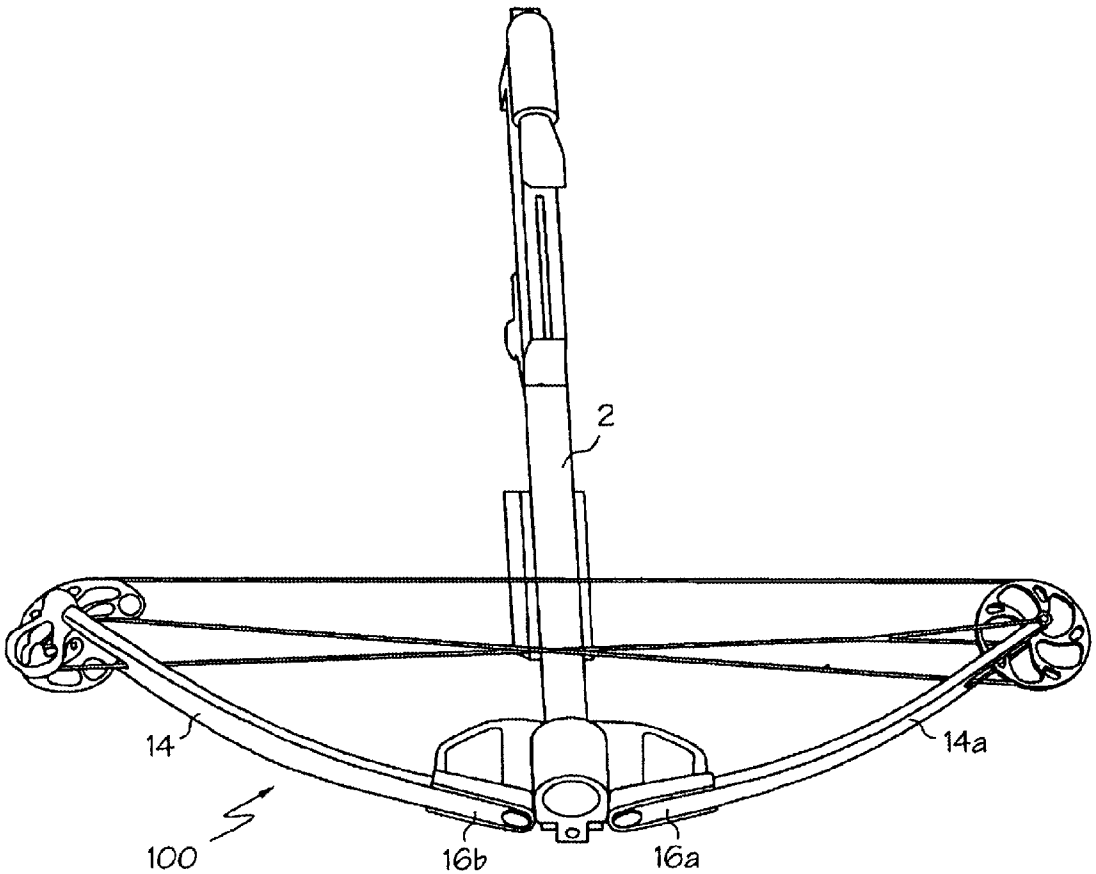
FIG. 13 is a perspective view of a crossbow having the limb pockets of the present invention.

FIG. 13 illustrates generally at 100, a crossbow according to the present invention in its undrawn state. Crossbow 100 includes a handle 2, a first limb pocket 16*a* securing a first limb 14*a* and a second limb pocket 16*b* securing a second limb 14*b*. Crossbows of this type are described in commonly assigned U.S. Pat. No. 6,267,108 incorporated by reference herein in its entirety.

Figure 14:
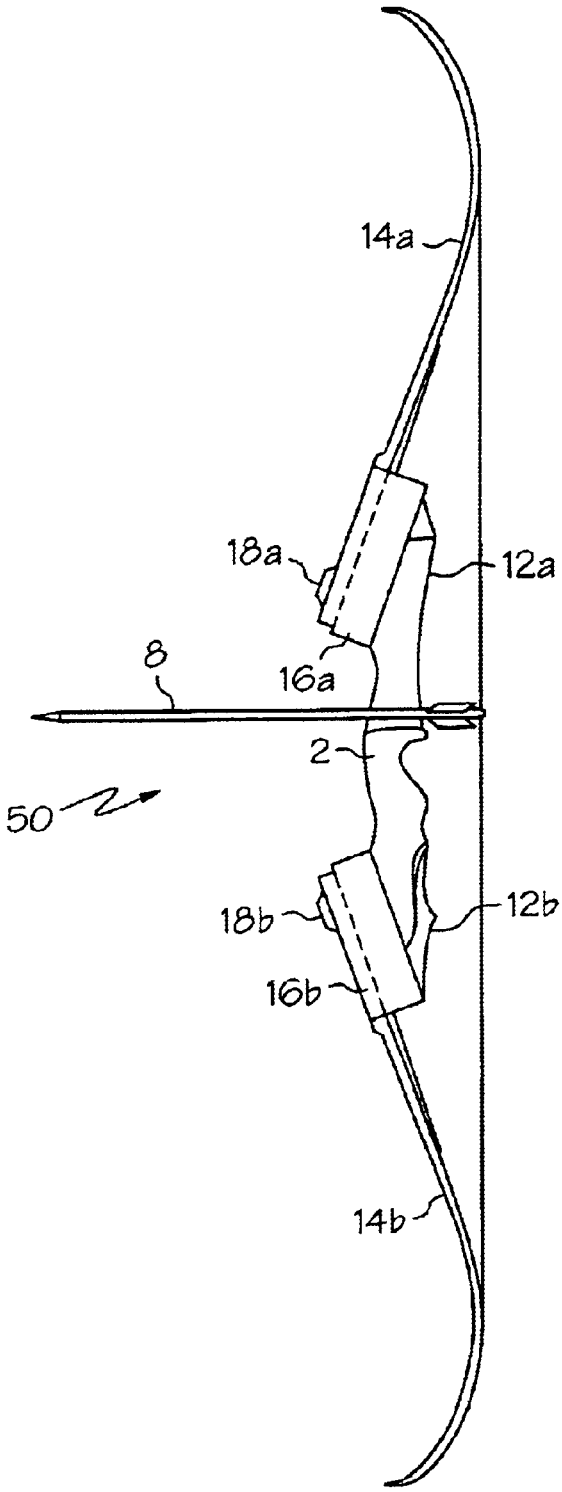
FIG. 14 is a perspective view of a recurve bow having the limb pockets of the present invention.

FIG. 14 illustrates generally at 50, a recurve bow according to the present invention in its undrawn state. Recurve bow 50 has a handle area 2, an upper limb 14*a* secured with a limb pocket 16*a*, both of which are secured to riser 12*a* with bolt or screw 18*a* and an lower limb 14*b* secured with a limb pocket 16*a* further secured to riser 12*b* with bolt or screw member 18*b*. The securement members 16*a*, 16*b* for preventing lateral movement or vibration when the arrow is released.

Figure 15C:
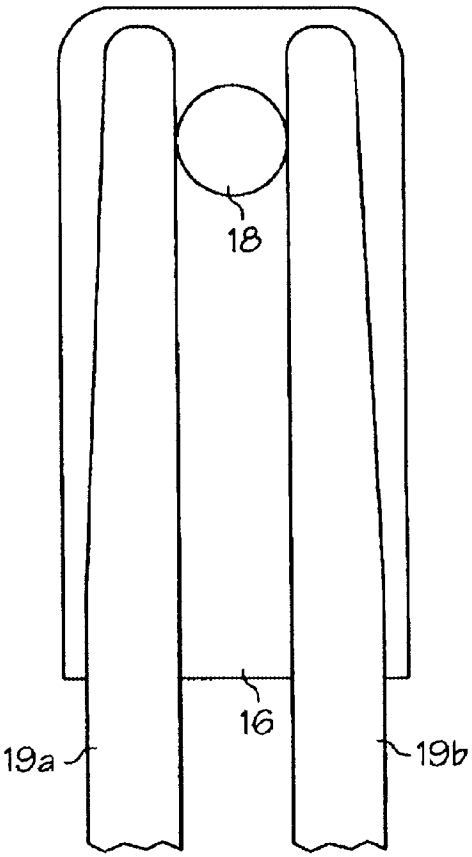
FIGS. 15*a*–15*c* illustrate alternative embodiments in which a limb pocket of the present invention is employed with various configurations of a split-limb.
Figure 15B:
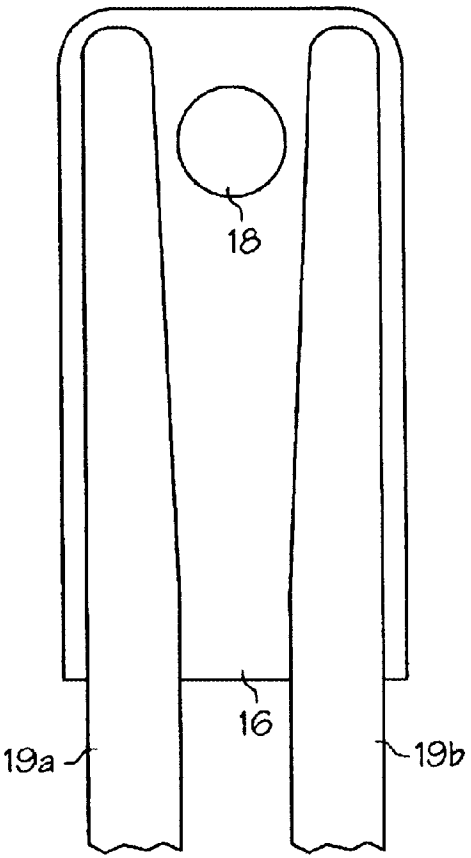
Figure 15A:
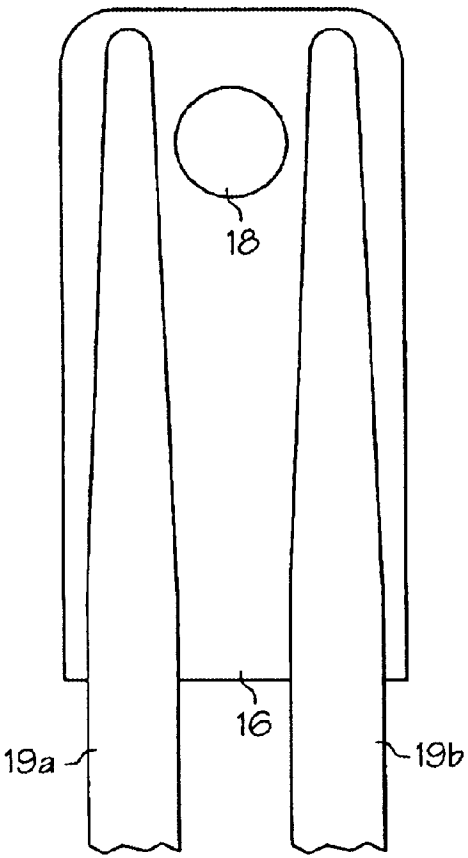

FIGS. 15*a*–15*c* illustrate the innovative limb pocket of the present invention employed in combination with alternative embodiments of a split limb having limb members 19*a*, 19*b* secured with limb pocket 16 which may further be attached to a riser (not shown) of a bow handle (not shown) by limb bolt or screw. Split limb compound bows are described, for example, in U.S. Pat. No. 5,722,380 incorporated by reference herein in its entirety.

The present invention may also be employed with extended fork compound archery bows such as, for example, those described in U.S. Pat. No. 5,947,099 incorporated by reference herein in its entirety.

The present invention exhibits an improvement in the accuracy, precision and consistency which an archer obtains with the performance of an archery bow. The innovative limb pocket of the present invention inhibits the lateral movement of the limb as the arrow is launched yet allows for longitudinal movement as desired.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

What is claimed is:

1. An archery bow comprising a handle portion, at least one limb and at least one limb pocket having a bottom, two linear and non-parallel side walls and an end wall portion, the at least one limb pocket being engaged to an end of the handle portion, wherein at least a portion of said at least one limb is fully and slidably engaged by said at least one limb pocket on at least said two side walls of said limb pocket.

2. The archery bow of claim 1 wherein said at least a portion of said at least one limb is at least partially engaged by said bottom of said limb pocket.

3. The archery bow of claim 1 wherein said limb portion further includes an opening for receiving a limb bolt.

4. The archery bow of claim 1 wherein said side walls, end wall portion and said bottom of said limb pocket substantially define the shape of said limb portion which is engaged to said limb pocket.

5. The archery bow of claim 1 wherein said limb pocket is v-shaped.

6. The archery bow of claim 1 wherein said limb pocket further comprises a vibration dampening device.

7. The archery bow of claim 1 wherein said bottom of said limb pocket further defines a hole for receiving a limb bolt.

8. The archery bow of claim 1 wherein said limb pocket is engaged to said handle with a bolt.

9. The archery bow of claim 8 wherein said limb pocket is pivotally engaged to said handle.

10. The archery bow of claim 1 wherein said two side walls of said limb pocket taper to said end portion of said limb pocket.

11. The archery bow of claim 10 wherein said bow limb tapers in conjunction with said limb pocket.

12. The archery bow of claim 1 wherein said archery bow is a compound bow, a crossbow, or a recurve bow.

13. The archery bow of claim 1 wherein said limb pocket is u-shaped.

14. The archer bow of claim 1 wherein said two side walls of said limb pocket taper to said bottom of said limb pocket.

15. The archery bow of claim 14 wherein said bow limb tapers in conjunction with said limb pocket.

16. A limb pocket having a bottom, two linear and non-parallel side walls and an end wall portion and a limb portion fully and slidably engaged by at least said two side walls of said limb pocket.

17. The limb pocket of claim 16 wherein said two side walls, said end wall portion and said bottom of said limb pocket substantially define the shape of said limb portion which is slidably engaged by said limb pocket.

18. The limb pocket of claim 16 wherein said limb pocket is v-shaped.

19. The limb pocket of claim 16 wherein said two side walls of said limb pocket taper to said end wall portion.

20. The limb pocket of claim 19 wherein said limb portion tapers correspondingly with said two side walls of said limb pocket.

21. The limb pocket of claim 16 wherein said limb portion which further includes an opening for receiving a limb bolt.

22. The limb pocket of claim 16 wherein said limb portion is further at least partially engaged by said bottom of said limb pocket.

23. The limb pocket of claim 16 further wherein said bottom of said limb pocket further defines a hole for receiving a limb bolt.

24. The limb pocket of claim 16 wherein said limb pocket is u-shaped.

25. An archery bow comprising a handle portion, at least one limb, at least one limb packet having a bottom, two side walls and an end wall portion an at least one limb pocket liner substantially defining the shape of said limb pocket, the at least one limb pocket being engaged to an end of the handle portion, wherein at least a portion of said at least one limb is fully and slidably engaged by said at least one limb pocket liner, said limb pocket liner fully and slidably engaged with said at least one limb pocket.

26. A limb pocket having a bottom, two side walls and an end wall portion, said limb pocket further comprising a removable limb pocket liner, said limb pocket liner having a bottom, two side walls and an end wall portion, said limb pocket liner substantially defining the shape of said limb pocket, and a limb portion fully and slidably engaged by said limb pocket liner by at least said two side walls and at least partially engaged by said bottom of said limb pocket liner.

27. The limb pocket of claim 26 wherein said limb pocket liner substantially defines the shape of said limb at the portion wherein said limb fully and slidably engages said limb pocket liner.

* * * * *